US010240357B2

(12) United States Patent
Cockerell

(10) Patent No.: US 10,240,357 B2
(45) Date of Patent: Mar. 26, 2019

(54) WORKING DECK NETTING SYSTEM AND RELATED METHODOLOGY

(71) Applicant: Safety Guys, LLC, Dania Beach, FL (US)

(72) Inventor: Chris Cockerell, Hollywood, FL (US)

(73) Assignee: SAFETY GUYS, LLC, Dania Beach, FL (US)

( * ) Notice: Subject to any disclaimer, the term of this patent is extended or adjusted under 35 U.S.C. 154(b) by 90 days.

(21) Appl. No.: 15/347,625

(22) Filed: Nov. 9, 2016

(65) Prior Publication Data

US 2018/0127994 A1 May 10, 2018

(51) Int. Cl.
*A62B 1/22* (2006.01)
*E04G 21/32* (2006.01)

(52) U.S. Cl.
CPC ..... *E04G 21/3266* (2013.01)

(58) Field of Classification Search
CPC ..... E04G 21/3266; E04G 21/3261; E04G 21/3219; E04G 21/3223; E04G 21/3247; E04G 5/001; E04G 5/064; E04G 11/20; E04G 11/28; E04G 3/18; E04G 2005/148; H05K 999/99
See application file for complete search history.

(56) References Cited

U.S. PATENT DOCUMENTS 3,949,834 A 4/1976 Nusbaum
4,074,791 A 2/1978 Inman
4,805,735 A * 2/1989 Anderson ..... E04G 1/20 182/129
4,838,382 A 6/1989 Nusbaum
4,856,615 A 8/1989 Nusbaum
4,892,169 A 1/1990 Duncan
4,944,365 A 7/1990 Shalders
4,962,828 A 10/1990 Duncan
5,161,641 A 11/1992 Nusbaum
D331,529 S * 12/1992 Reinklou ..... D8/355
5,299,654 A 4/1994 Duncan
5,429,206 A 7/1995 Nusbaum
6,098,750 A * 8/2000 Reynolds ..... A62B 1/22 182/112
6,186,274 B1 * 2/2001 Reynolds ..... A62B 1/22 182/112
6,585,080 B2 * 7/2003 Murray ..... E04G 21/3233 182/45
6,857,504 B1 * 2/2005 Branter ..... E04G 3/26 182/113

(Continued)

*Primary Examiner* — Jerry E Redman
(74) *Attorney, Agent, or Firm* — Lewis Brisbois Bisgaard & Smith LLP; Geoffrey Lottenberg, Esq.

(57) ABSTRACT

A debris netting system configured to installation on a working deck to provide a vertical barrier or wall to protect against the spread of debris, overspray, concrete, and the like. The system includes plurality of spaced apart brackets attached to the working deck with a mesh liner or net attached to and disposed between adjacent brackets. The brackets include vertically extending poles each having a pulley system to attach, retain, and adjust the height of the net. Each pole may have two pulley systems to accommodate a plurality of nets extending away from each bracket. The system is modular to form a series of debris nets to form a wall or barrier that can conform to the geometry of a particular working deck or other area require debris containment.

8 Claims, 3 Drawing Sheets

(56) References Cited

U.S. PATENT DOCUMENTS

| | | | | |
|---|---|---|---|---|
| 7,258,198 | B2 | 8/2007 | Rexroad | |
| 7,322,553 | B2 | 1/2008 | Rexroad | |
| 7,389,955 | B2 | 6/2008 | Rexroad | |
| 7,503,372 | B1 * | 3/2009 | Jones | E04G 21/3261 160/351 |
| 7,806,232 | B2 * | 10/2010 | Thomas | E04G 21/3223 182/113 |
| 8,057,329 | B2 * | 11/2011 | Cusimano | A63B 61/02 473/490 |
| 8,376,086 | B1 * | 2/2013 | Moyer | E04G 21/3266 182/138 |
| 9,255,416 | B1 * | 2/2016 | Snell | E04G 21/16 |
| D794,151 | S * | 8/2017 | Ji | D21/797 |
| 9,731,640 | B1 * | 8/2017 | Meacham | B60P 1/00 |
| D796,614 | S * | 9/2017 | Chen | D21/797 |
| 9,758,360 | B2 * | 9/2017 | Stanford | B66F 17/006 |
| 9,908,023 | B1 * | 3/2018 | Hamm | A63B 69/0097 |
| 2006/0090961 | A1 * | 5/2006 | Rexroad | A62B 1/22 182/138 |
| 2006/0151243 | A1 | 7/2006 | Rexroad | |
| 2006/0237607 | A1 | 10/2006 | Rexroad | |
| 2010/0186159 | A1 * | 7/2010 | Dalickas | E04H 4/06 4/504 |
| 2013/0109539 | A1 * | 5/2013 | Chen | A63B 5/11 482/27 |
| 2014/0102829 | A1 * | 4/2014 | Stearns | A62B 1/22 182/139 |
| 2017/0298641 | A1 * | 10/2017 | Rexroad | E04G 21/3266 |

* cited by examiner

WORKING DECK NETTING SYSTEM AND RELATED METHODOLOGY

FIELD OF THE INVENTION

This application generally relates to safety and debris netting for working decks and more particularly to working deck netting system for retaining vertically disposed nets and liners to prevent the spread of debris during deck work.

BRIEF DESCRIPTION OF THE DRAWINGS

The drawings appended hereto are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION

Figure 1:
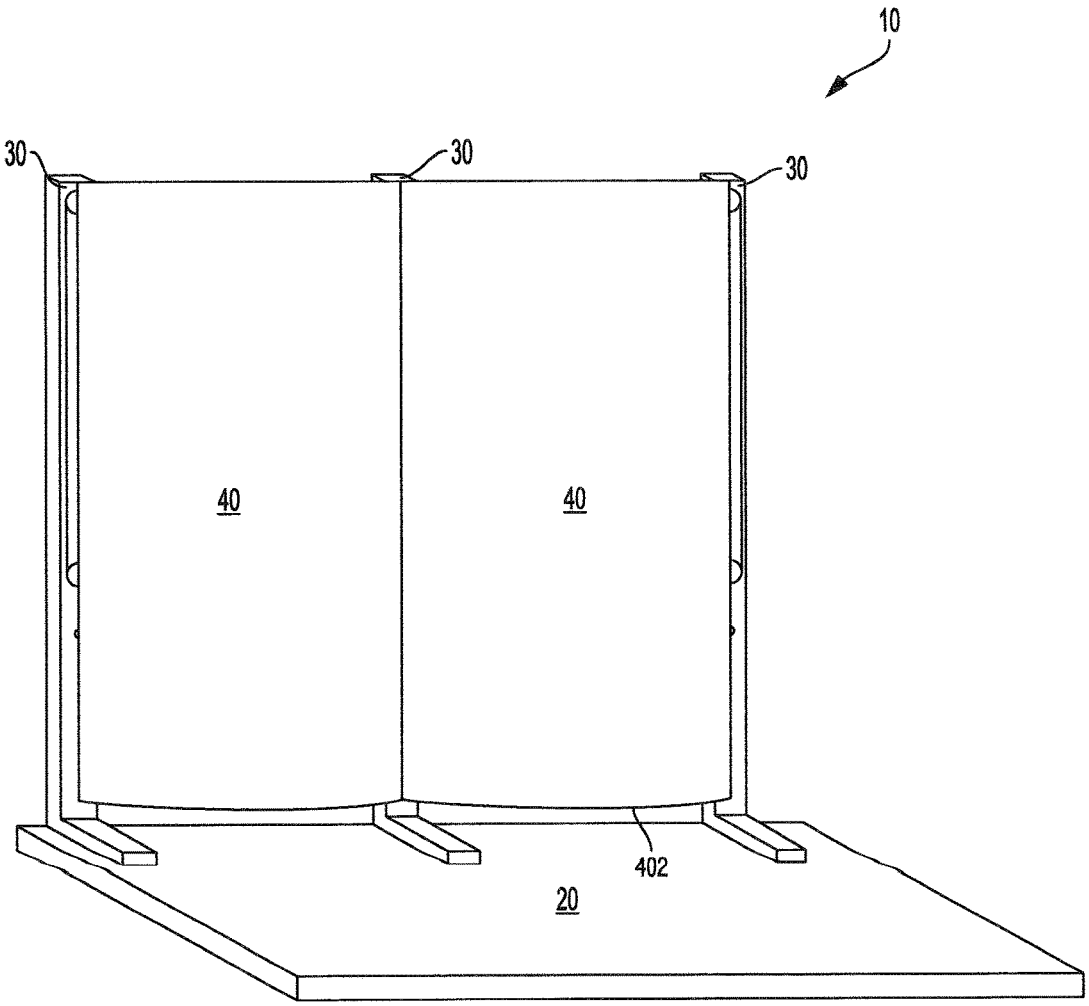
FIG. 1 is a schematic of one embodiment of the system of the present invention deployed on a working deck.

For the purposes of promoting an understanding of the principles of this disclosure, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc. Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional un-recited elements or method steps. "Comprising" is to be interpreted as including the more restrictive terms "consisting of" and "consisting essentially of."

With reference to FIG. 1 shown is a perspective view of one embodiment of the netting system 10 installed on an exemplary working deck 20. In some embodiments, the working deck 20 is a construction zone or area upon which concrete or other building material is laid in order to create a deck, floor, or other surface. The system 10 comprises array or a plurality of spaced apart vertically disposed retention brackets 30 disposed at least partially around the perimeter or other desired location of the working deck 20 so as to form an array of attachment points for one or more debris-retaining liners or nets 40 to be attached to and disposed between the brackets 30. The brackets 30 extend vertically upward from working deck 20 such that the nets 40 are positioned substantially perpendicular to the surface of the working deck 20 in order to collect or retain debris such as concrete or paint overspray that may be carried away from the working deck 20 during construction.

Figure 2:
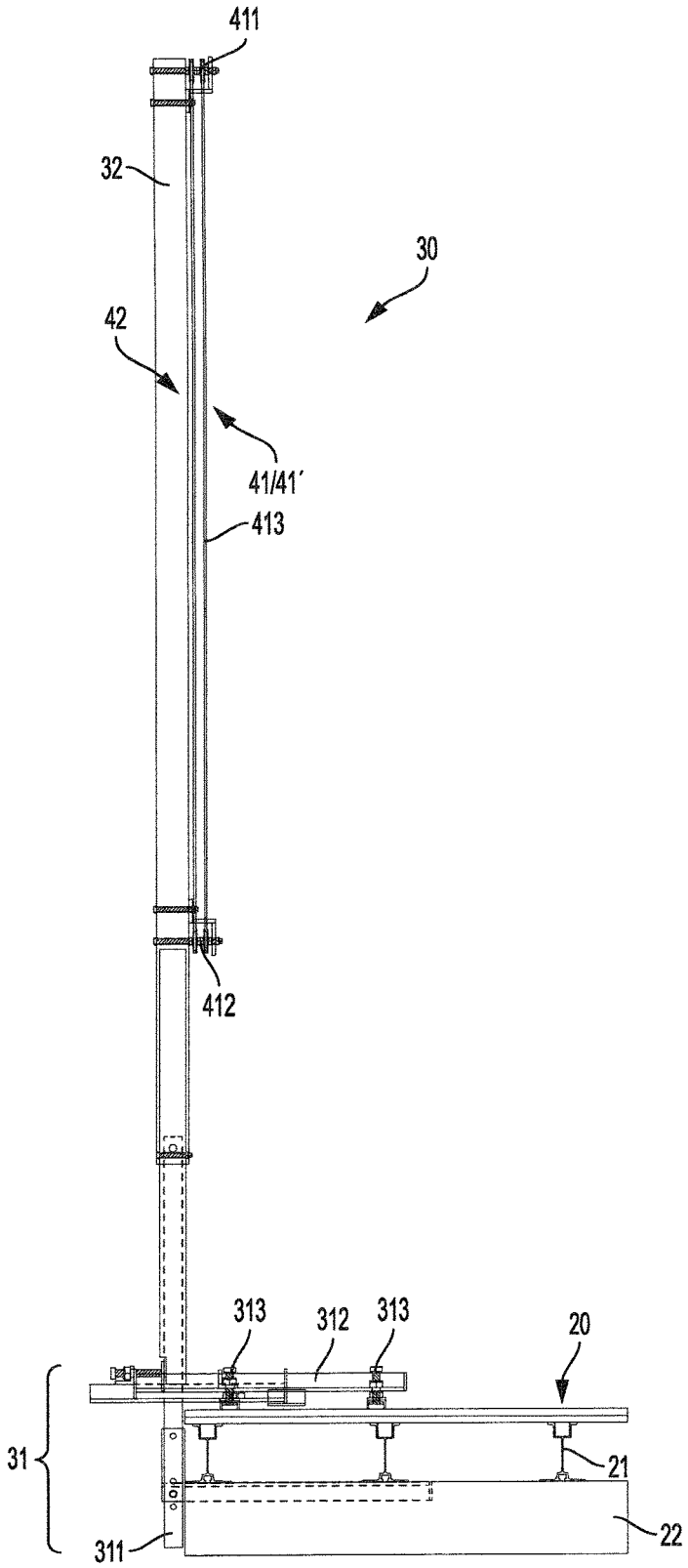
FIG. 2 is a side view of one embodiment of the bracket component of the system.
Figure 3:
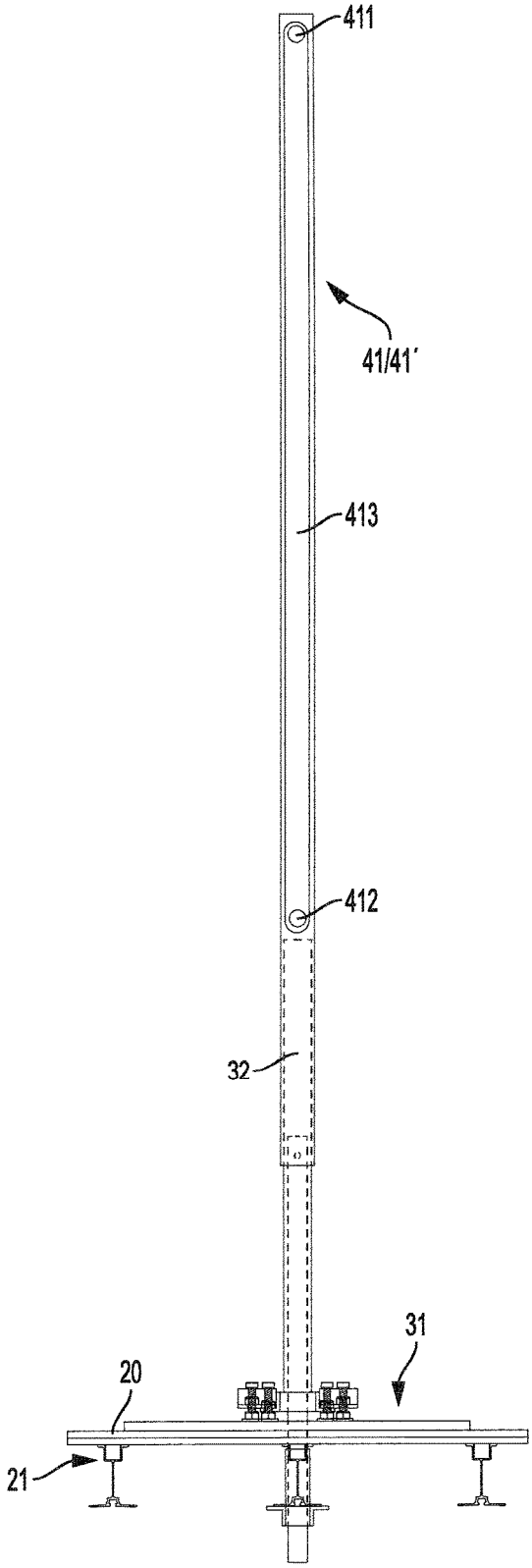
FIG. 3 is a front view of one embodiment of the bracket component of the system.

With reference to FIGS. 2-3, shown is one embodiment of the bracket 30 of the system 10. In some embodiments, the bracket 30 comprises a clamp base 31 and a pole 32 extending vertically from the clamp base 31. The clamp base 31 is configured to be secured to the working deck 20 and includes a fixed base member 311 with an optional adjustable clamp member 312 that permits the clamp base 31 to be secured to the working deck 20 by tightening or closing the clamp member 312 with respect to the fixed base member 311. Adjustable bolts 313 may be provided through the clamp member 312 to secure the clamp base 31 to a joint 21 and/or stringer 22 of the deck 20. The clamp base 31 is configured to be adapted to be secured to a variety of decking and floor surface configurations and has alternative securement features to accommodate bolts and fasteners.

The pole 32 extends upward from the clamp base 31 and provides a plurality of points of attachment for the one or more nets 40. In some embodiments, attached to the pole 32 are one or more pulley systems such as inner pulley system 41 and outer pulley system 41'. Each pulley system 41 and 41' comprises an upper pulley 411 and a lower pulley 412 vertically spaced apart along the length of said pole 32, with a cable 413 at least partially wrapped around and the upper and lower pulleys and thereby connecting the two pulleys. In some embodiments, the inner and outer pulley systems 41 and 41' are spaced apart or offset from one another in order for the pole 32 to accommodate a plurality of nets 40. One or more nets 40 are provided, attached at a lateral edge 401 thereof to the cables 413 of the respective pulley systems 41 and 41'. Attachment may be accomplished by eyelets in the net or other fasteners such as clamps, clips, snaps, or the like. This allows the nets 40 to be translatable or height adjustable along the length of at least a portion of each pole 32 and further allows the nets 40 to be held taught. In some embodiments, two nets 40 are attached to a pole 32, with a first net attached to 40 attached to a first pulley system 41 and a second net 40' attached to a second pulley system 41'.

In some embodiments, the bottom edge 402 of each net 40 should be secured at or adjacent to the deck 20 in order to avoid any gaps at the bottom thereof that could allow for the passage of debris. In some embodiments, wood planks or other weighted members are placed over and about the bottom edge 402 of each net 40 in order to removably retain the net 40. In some embodiments, eyelets, clamps, clasps or similar retaining and fasteners may be employed to attach at least a portion of the bottom edge 402 of each net 40 to the working deck 20.

The netting system 10 is configured to be modular to adapt to various sized and shape working decks and working areas. In some embodiments, a plurality of poles 32 are provided with at least one net 40 disposed between and retained by adjacent poles 32. For example, three poles 32 can be provided in a spaced apart relation, with two nets 40 provided, each net attached at their outer lateral edges 401 to the outer poles 32 and at the inner lateral edges 401 both to the central pole 32. The pulley systems can be selectively engaged as needed, for example in this configuration only one pulley system is provisioned on the outer poles 32 but both pulley systems 41 and 41' are provisioned on the central pole 32, each pulley system 41 and 41' assigned to retain a respective net 40. Additional poles 32 and nets 40 can be provided in sequential fashion as needed to cover a desired area.

It is appreciated and understood that the various system 10 components may comprise materials of varying material and cross-section. For example, wood, steel, aluminum, and combinations thereof may be employed for the poles 32 and attendant hardware. Cross-sections may vary as the poles 32 may be tubular, square, or L-shaped. The means and manner by which the poles 32 are secured to the working deck is not limiting although in some embodiments a clamp member 312 may be employed. Other hardware may be utilized to reinforce the attachment points on the slab such as bolts and other permanent or removable fasteners. The net 40 can vary in type, thickness and designed although it may desirable to employ a net 40 with a fine mesh backing or fine mesh array in order to retain and prevent the dispersion of debris, especially that occurring during stucco, tile, and concrete application. The means of attaching the nets 40 to the cables 413 of the pulley systems 41 and 41' of the brackets can vary but may include hooks, clips, eyelets, and other like fasteners or securements.

By way of non-limiting example, it is helpful to describe certain relative dimensions of system components. In some embodiments, it is desirable for each of the poles 32 to extend upward to a maximum height of 12 feet in order to provide optimal coverage and retention of debris during material application to the working deck. The spacing of the poles 32 may also vary although in one embodiment it is desirable that the brackets are spaced apart no greater than 15 feet in order to accommodate nets 40 or reasonable size and workability.

The system 10 of the present invention is designed to be installed and secured to a working deck in order to provide a substantially vertical protective barrier or wall that can catch and retain construction debris. In some embodiments, the system 10 is located downwind of a weather-exposed working deck such that the nets 40 have the best opportunity to catch, retain, and prevent the spread of construction debris. The system 10 can adapted to be installed in a modular fashion in varying size, shape, dimensions and orientations as the angle between adjacent nets can be adjusted by adjusting the relative location of the poles 32. This allows the system 10 to confirm to the size, shape, dimensions, and other requirements of the working deck or space where debris containment is desired. The system 10 is also designed to be modular in order to permit its usage in a variety of applications and with various sized, shaped, and configured working decks and can even be configured to entirely encircle or encompass a working deck, or otherwise only partially so. The system 10 may can be employed in a variety of building applications including high rise construction, low rise construction, bridge construction, and the like.

While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A debris netting system for construction, comprising:
- a plurality of spaced brackets adapted to interconnect to a working deck, each bracket comprising:
  - a clamp base and a first pole extending from said clamp base;
  - a second pole having a first end and a second end that defines a second pole length, said second end comprised of a cavity having a length less than said second pole length, wherein said second pole is configured to selectively receive said first pole within said cavity;
  - a first pulley operatively interconnected to said second pole adjacent to said first end of said second pole;
  - a second pulley operatively interconnected to said second pole adjacent to said first second pole at a point adjacent to a closed end of said cavity;
  - a cable operatively interconnected to said first pulley and said second pulley;
- at least one net configured to be disposed between adjacent brackets of the plurality of spaced brackets, said net interconnected at the lateral edges thereof to cables of said adjacent brackets; and
- wherein a bottom edge of said at least one net is secured to a top surface of the working deck such that said bottom edge is located adjacent to the working deck, wherein said system provides a substantially vertical protective barrier.

2. The debris netting system of claim 1, further comprising a third pulley located adjacent to said first pulley, a fourth pulley located adjacent to said second pulley, and a second cable operatively interconnected to said third pulley and said fourth pulley.

3. The debris netting system of claim 1, wherein said first pulley and second pulley of adjacent brackets, which are interconnected to opposite lateral edges of said net, selectively translate said net along at least a portion of said first and second poles of said adjacent poles.

4. The system of claim 1, wherein said clamp base includes an adjustable clamp member configured to engage and secure to the working deck.

5. A debris netting system for construction, comprising:
- a first bracket and a second bracket, each of said brackets sequentially disposed and spaced apart and each comprising:
  - a first pole extending from a clamp base;
  - a second pole having a first end and a second end that defines a second pole length, said second end comprised of a cavity having a length less than said second pole length, wherein said second pole is configured to selectively receive said first pole within said cavity;
  - a pulley system, comprising:
    - a first pulley operatively interconnected to said second pole adjacent to said first end of said second pole;

a second pulley operatively interconnected to said second pole adjacent to said first second pole at a point adjacent to a closed end of said cavity;

a cable operatively interconnected to said first pulley and said second pulley;

a net disposed between and attached to said cables of said first and second brackets; and wherein a bottom edge of said at least one net is secured to a top surface of the working deck such that said bottom edge is located adjacent to the working deck, wherein said system provides a substantially vertical protective barrier.

6. The debris netting system of claim 5, wherein each of said plurality of brackets includes two pulley systems spaced apart from one another.

7. The debris netting system of claim 6, wherein said pulley systems are each engaged to selectively translate said net along at least a portion of said first and second pole.

8. The system of claim 5, wherein said clamp base has an adjustable clamp member configured to engage and secure to said working deck.

* * * * *